United States Patent [19]

Lemelson

[11] 4,357,602

[45] Nov. 2, 1982

[54] FIRE DETECTION AND WARNING SYSTEM

[76] Inventor: Jerome H. Lemelson, 85 Rector St., Metuchen, N.J. 08840

[21] Appl. No.: 188,050

[22] Filed: Sep. 17, 1980

Related U.S. Application Data

[63] Continuation-in-part of Ser. No. 63,721, Aug. 6, 1979, abandoned.

[51] Int. Cl.[3] ..... G08B 17/06

[52] U.S. Cl. ..... 340/539; 340/524; 340/577; 340/584

[58] Field of Search ..... 340/506, 524, 525, 531, 340/532, 539, 540, 577, 578, 584, 590, 291

[56] References Cited

U.S. PATENT DOCUMENTS 2,804,610 8/1957 Curtis et al. ..... 340/590
3,559,194 1/1971 Bisberg ..... 340/539

FOREIGN PATENT DOCUMENTS 1361499 7/1974 United Kingdom ..... 340/539

*Primary Examiner*—Alvin H. Waring

[57] ABSTRACT

A fire detection system is provided employing a plurality of electronic fire detection units, each of which is a code generating and short wave transmitting unit which derives electrical energy for powering the unit from the heat of a fire. In one form, each unit is operable to generate a specific code identifying the unit and its location which code is short wave transmitted directly to a monitor station. The receipt and recording or display of the code is an indication of the location of the unit which becomes activated by heat. The extent of the fire can be determined by the number of units which are so activated as indicated by the number of different codes received by the monitor station. Each detection unit is preferably self insulated against immediate destruction of the electronic circuit thereof, to permit the unit to transmit a remotely detectable code. Where the monitor station is a substantial distance from the detection unit, an intermediate transponder receiving and transmitting station is located within range of a given number of such units and is operable to retransmit codes received thereby from those units which are activated by heat, to a remote monitor station. An entire fire detection and monitoring system may be composed of a number of such transponders, each of which is host to a plurality of detection units, the short wave signals of which are within receiving range of the particular transponder associated therewith. One or more of the detection units and transponder units may be powered by batteries which are rechargable by means of solar cells or are held inactivated until the heat of a fire activates the battery.

12 Claims, 3 Drawing Figures

FIRE DETECTION AND WARNING SYSTEM

RELATED APPLICATIONS

This is a continuation-in-part of Ser. No. 63,721 filed Aug. 6, 1979, and now abandoned.

SUMMARY OF THE INVENTION

This invention relates to a fire detection and warning system and in particular to such a system which employs a series of fire detection units which are low in cost each of which includes the short wave transmitter of a code signal which becomes activated by energy derived from the heat of a fire and which transmits a radio code signal or signals to either a remote monitor station or local transponder station which retransmits the code to the monitor station.

By employing microminiature electronics for the fire detectors and transmitters, a system may be provided which is low in cost, substantially foolproof in operation and does not require maintenance with respect to the detectors.

Accordingly, it is a primary object of this invention to provide a new and improved fire detection and warning system having many applications.

Another object is to provide a fire detection and warning system which does not require wire connections to fire sensing devices for sensing fire at different locations.

Another object is to provide an improved fire detection system which does not require a source of electrical energy remote from the plurality of fire detection sensors for energizing same.

Another object is to provide a fire detection system which may be easily installed and used to detect fire in buildings such as homes, office buildings, apartments, factories and the like without the need for special wiring or other provision of operating sources of electrical energy.

Another object is to provide a fire detection system which is readily applicable to detect fires in wooded areas, such as forests.

Another object is to provide a low cost fire detection and warning system which does not require substantial maintenance for long periods of time.

Another object is to provide a fire detection system which is not subject to failure due to power bus or power line failure.

Another object is to provide a fire detection system which is not subject to failure due to wire destruction by rodents and other pests.

Another object is to provide a fire detection system which may be installed by merely placing devices at different locations to be protected against fires.

Another object is to provide a fire detection system which is both self powered and solar powered in its operation.

With the above and other such objects in view as will may hereinafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed without departing from the spirit of the invention.

Figure 1:
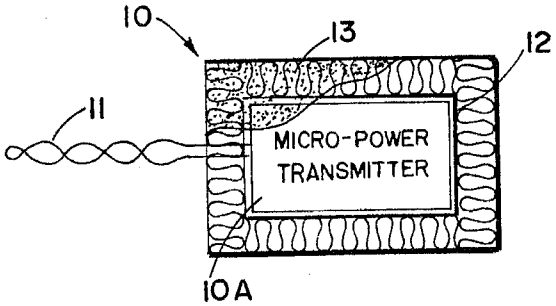
FIG. 1 is a plan view of a self-contained fire detector or sensor and short wave transmitter of a code signal indicative that the sensor thereof has been activated and identifying such sensor and its location by means of the code transmitted.

In FIG. 1 is shown one of a number of fire detection units 10 forming part of an automatic fire detection system, each one of which units is disposed at a different location in a building, group of buildings, chemical plant, storage area, a military installation, forest or wooded area, etc. The detection unit 10 includes a low power short wave code signal transmitter 10A which is powered by electrical energy derived when a thermocouple device 11, which may comprise one or a series of separate thermocouples or other heat-to-electrical energy converters supported on a substrate such as an insulated chip, strip or other material, and which thermoelectrically operates to generate electrical energy from the heat of a fire when such fire occurs in the vicinity thereof. The transmitter 10A radiates its short wave power at a select frequency or frequencies or code on an output antenna 12. An insulating layer 13, of suitable insulating material, surrounds the transmitter and is provided to protect the transmitter electronics from the adverse effects of the heat of a fire for a sufficient period of time to permit the transmitter to transmit a detectable signal or signals which preferably include a code signal indicative of the location of the transmitter.

Figure 2:
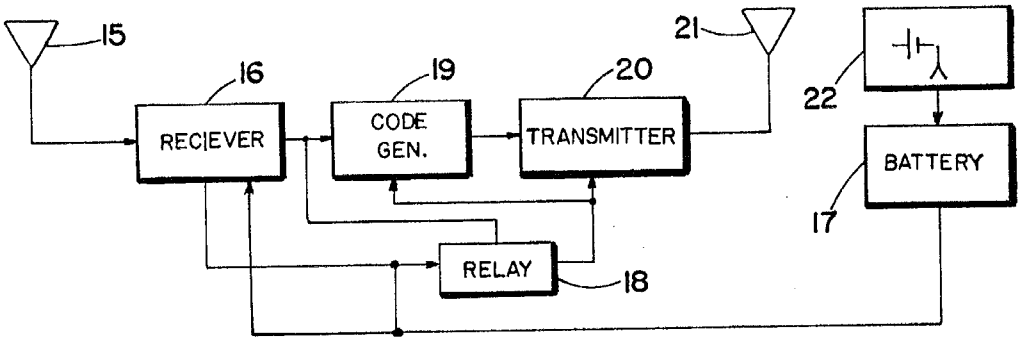
FIG. 2 is a schematic diagram of a relay station or transponder within range of the signals generated by the device of FIG. 1

In FIG. 2, an intermediate transponder 14 is provided, which is within range of a number of transmitters of the type illustrated in FIG. 1. Such intermediate transponder is utilized if an alarm is to be generated at a great distance from the transmitters of the fire detection system. A receiving antenna 15 picks up signals transmitted to the transponder by one or more of the transmitters 10A of the system and provides such signals on the input to a receiver 16 which is powered by a battery 17 or other source of electrical energy. On receipt of a fire indicating signal by the transponder antenna 15, a relay means 18 is activated by energy generated on the output of said antenna and transfers power from the battery 17 to a code generator 19 and a short wave transmitter 20. Code generator 19 generates a code signal as a series of tones on the input to a short wave transmitter 20, which it modulates and which, in turn, radiates such code as pulses or tones at sufficient power to be detected by a central fire watch station of the type shown in FIG. 3, on an antenna 21. In FIG. 2, the battery 17 is maintained at full charge by means of a solar cell or series of such cells 22 connected so as to charge the battery during periods of inactivity, when solar energy is present and the only current drain is that effected by receiver 16.

Figure 3:
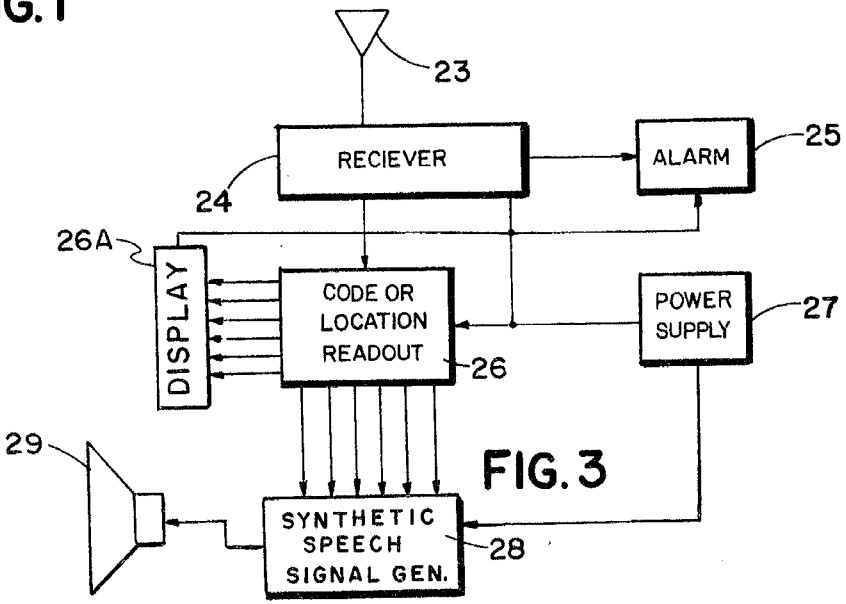
FIG. 3 is a schematic diagram of a monitor station for indicating the existence and location of a fire or fires as detected by one or more units of the type shown in FIG. 1.

In FIG. 3 is shown details of a central fire watch station which is responsive to signals generated by a number of such fire detectors and transponders. An antenna 23 picks up signals from transponders of the type shown in FIG. 2 and provides such signals on the input to a receiver 24 which, in turn, activates a fire alarm 25. A code decoder 26, receives the code generated by a remote fire detector or transponder and displays such information on a digital or other type of readout 26D. An indication of the location of the fire may also be provided by means of a synthetic speech synthesizing circuit 28 which is activated by the output of the code decoder 26, to generate synthetic speech signals which are applied to speaker 29 generating sounds of words which define a location or locations of the fires. Power supply 27 energizes the receiver 24, alarm 25, code location readout 26 and speech synthesizer circuit 28 activated by the signals generated on the output of the code location readout 26. The decoding unit 26 may comprise a computer or suitable electronic microprocessor which is operable to receive and analyze the fire indicating code signal generated by code generator 19 or the code generator of the circuit 10A of the detection unit energized by heat and output suitable control signals for the display 26A and the speech signal generator 28 which may comprise a Texas Instruments TMC 0280;5000 or 6100 electronic circuit or the like with a suitable digital-to-analog converter for converting the digital speech signals generated to analog speech signals for transduction to speech sounds of words by the speaker 29.

Variations in the described fire detection system are noted as follows:

I. The system may be employed to detect and remotely indicate fires in buildings, such as homes. Each building in a local group of buildings may contain one or more detectors of the type shown in FIG. 1. If a plurality of detectors are employed in a small building, such as a home dwelling, they may each contain microelectronic circuits which are similarly coded with all operable to short wave transmit its code when activated by the heat of a fire, to either a transponder or retransmitter on the roof of the building and/or to a transponder located on the local telephone pole or fire alarm box for retransmission of the code by short wave or on the line wire pair or cable of the fire alarm box to a central station, such as located at the local fire station.

II. In larger buildings, such as apartment houses, factories, office buildings, etc. each room or group of rooms thereof may contain a device of the type shown in FIG. 1 which device is differently coded than the devices of the other rooms or apartments so as to indicate the room or apartment in which the fire is located. A plurality of similarly coded devices may be disposed in each apartment or group of rooms.

III. In the detection of fires in a forest, detection units of the type described may be secured to trees. Similarly, a transponder unit, as described, may also be secured to a tree in a particular location and a variety of transponder units situated at different selected locations may each be operable to receive signals from a plurality of fire detection units within a given radius so that an entire forest area may be monitored for fire.

IV. A plurality of fire detection units of the type illustrated in FIG. 1, may be provided within a given building, such as a dwelling or office building containing a transponder operable to receive signals transmitted by any of such detection units and associated with further electronic or electromechanical means for generating a code signal or signals operable to effect a telephone line connection with a monitor station at a terminal circuit of the telephone system for indicating by means of the code signals generated by the detection unit, the address location of the building containing the fire detection unit or units activated by a fire or fires. In other words, the signal is generated by the transponder or an associated circuit, and may be operable to actually dial-up a number in the telephone system and to automatically effect connection between the telephone circuit associated with the building and a telephone circuit associated with the monitor station.

V. In a modified form of the invention, devices of the type shown in FIG. 1 may each contain a respective speech-signal processing and generating electronic chip such as the Texas Instruments TMC-0270, TMC 0350, TMC 5000, TMC 6100 or the General Instruments Corporation LISP-0256 or a modified form of the Texas Instruments TMC 1000 operable to generate, when activated, a specific word or group of words speech signals in digital form which signals are transmitted to the monitor station or transponder for retransmission thereof to a monitor station wherein such word or speech signals indicate, when converted to speech by digital-to-analog conversion and transducing in a speaker, in words indicative of the fire and its location as defined by the location of the detection unit 10 being activated by the heat of the fire.

VI. In yet another form of the invention, the detection unit may contain one of the aforementioned speech-signal generating electronic chips and a short wave transmitter on the same chip or connected thereto to generate synthetic speech signals indicative of the location of the chip when it detects a variable other than a fire such as force thereon caused by a person walking or a vehicle whose wheels roll over the unit or a mount therefore or when a movement or vibration sensor senses movement or vibrations of specific kinds or intensities. Power for such units may be derived from batteries per se or charged by respective solar cells or by piezoelectric transducers operable to generate output electrical energy for use in energizing the detector, code generator and short wave transmitter circuits of such chip or chips. When so activated, the chip(s) may be programmed to generate synthetic speech digital signals which are short wave transmitted to a local or remote monitor station or speaker where they are converted to analog speech signals of such words and phrases as "intruder at location ___"; "tresspasser at ___ location"; "break-in at location ___"; "vehicle passing ___ location"; etc.

I claim:

1. A fire detection system comprising in combination:

a monitor station including a short wave receiver for information defining the outbreak of fires and fire locations and means for indicating the presence of fires and their locations in an area under surveillance, said fire detection units each comprising:

(a) first means sensitive to the heat of a fire for generating electrical energy, (b) second means for receiving said electrical energy generating code electrical signals, (c) third means energized by said electrical energy for short wave transmitting said code signals, said monitor station being operable to receive short wave code signals indicative of a fire when a fire detection unit becomes activated and means at said monitor station responsive to the received signals for indicating the existence and location of a fire, and transponder means within receiving range of at least certain of said short wave transmitting means of said fire detection units for receiving signals generated thereby and operable for transmitting code signals indicative of fire and its location to said monitor station.

2. A system in accordance with claim 1 wherein said second means of said fire detection units is operable, when energized by the activation of said first means, to generate a unique code which is short wave transmitted by said third means.

3. A system in accordance with claim 2 wherein said transponder is operable to retransmit the code received from those detection units which are activated by the heat of fire, to said monitor station.

4. A system in accordance with claim 1 including code generating means at said transponder for generating a code when the transponder receives a short wave signal from one of said detection means, which code is indicative of the location of the transponder and means for transmitting the code generated by the transponder to said monitor station.

5. A system in accordance with claim 1 wherein said monitor station short wave receiver is operable to receive signals generated and transmitted by the short wave transmitters of at least some of said detection devices.

6. A system in accordance with claim 5 including display means at said monitor station for displaying information indicative of the detection units in said system which are activated by heat.

7. A system in accordance with claim 1 introducing synthetic speech signal generating means at said monitor station containing recordings representative of words capable of being combined to generate a plurality of sound indications of the different locations of the area protected by said fire detection systems and at which respective of said fire detection units are located, and code signal decoding means at said monitor station connected to said monitor station receiver for controlling the operation of said synthetic speech signal generating means to cause it to generate synthetic speech signals which are indicative of the location of a fire.

8. A system in accordance with claim 1 wherein said detection units are located in buildings, such as homes and dwellings, in a block area of a community and said transponder is situated on a telephone pole in the vicinity of said buildings.

9. A fire detection system comprising:

a plurality of fire indicating stations each having means for generating a code signal unique to and identifying the station, a monitor station having code signal receiving means, means at each code indicating station for transmitting the code signals generated by its signal generating means to the receiving means of the monitor station, decoding means at the monitor station and synthetic speech signal generating means connected to said decoding means for generating synthetic speech signals which are indicative of the location of a fire as indicated by the code signals received, and means for transducing the synthetic speech signals generated by said synthetic speech generating means to sounds of words defining the locations of the stations from which code signals are received.

10. A system in accordance with claim 9 including means for repeating the generation of synthetic speech signals indicative of the location of a fire, a number of times for providing speech indications on the output of said transducing means a number of times.

11. A system in accordance with claim 10 including short wave transmitting means at said monitor station for short wave transmitting synthetic speech signals which are indicative of the location of a fire.

12. A fire detection device in accordance with claim 1 including a thermoelectric generator and a microminiature electronic circuit said circuit including insulation means therearound for protection from the heat of a fire for a long enough time to permit said thermoelectric generator to generate sufficient electrical energy to activate said electronic circuit, cause said first circuit means to generate its code and cause said short wave transmitting means to short wave transmit said code.

* * * * *